US008591093B2

(12) United States Patent
Schoenfeld

(10) Patent No.: US 8,591,093 B2
(45) Date of Patent: Nov. 26, 2013

(54) ACOUSTIC MIXING ELEMENT AND MIXING DEVICE HAVING SUCH AN ELEMENT

(75) Inventor: Friedhelm Schoenfeld, Mainz (DE)

(73) Assignee: Institut fur Mikrotechnik Mainz (DE)

( * ) Notice: Subject to any disclaimer, the term of this patent is extended or adjusted under 35 U.S.C. 154(b) by 1038 days.

(21) Appl. No.: 12/597,403

(22) PCT Filed: Apr. 19, 2008

(86) PCT No.: PCT/EP2008/003163
§ 371 (c)(1),
(2), (4) Date: Oct. 23, 2009

(87) PCT Pub. No.: WO2008/128735
PCT Pub. Date: Oct. 30, 2008

(65) Prior Publication Data

US 2010/0135104 A1 Jun. 3, 2010

(30) Foreign Application Priority Data

Apr. 24, 2007 (DE) ..... 10 2007 020 244

(51) Int. Cl.
*B01F 11/00* (2006.01)

(52) U.S. Cl.
USPC ..... 366/108; 366/118; 366/168.1; 366/168.2; 366/275; 366/279; 366/343

(58) Field of Classification Search
USPC ..... 366/130, 343, 342, 108, 118, 168.1, 366/168.2, 275, 279
See application file for complete search history.

(56) References Cited

U.S. PATENT DOCUMENTS

| | | | | |
|---|---|---|---|---|
| 5,114,074 | A * | 5/1992 | Frauenthal et al. | 239/33 |
| 5,201,460 | A * | 4/1993 | Caines | 229/103.1 |
| D440,810 | S * | 4/2001 | Olson | D7/300.2 |
| 6,210,128 | B1 | 4/2001 | Rife et al. | |
| 6,230,913 | B1 * | 5/2001 | Cornell et al. | 215/387 |
| 6,431,434 | B1 * | 8/2002 | Haughton et al. | 229/103.1 |
| 6,460,777 | B2 * | 10/2002 | Float et al. | 239/33 |
| 6,676,032 | B2 * | 1/2004 | Banach | 239/33 |
| 6,745,949 | B2 * | 6/2004 | Lee | 239/33 |

(Continued)

FOREIGN PATENT DOCUMENTS

| | | | |
|---|---|---|---|
| DE | 19923378 | C2 | 11/2000 |
| DE | 10013311 | C2 | 9/2001 |
| FR | 2770152 | | 4/1999 |
| ZA | 9809846 | A | 4/1999 |

OTHER PUBLICATIONS

PCT/ISA/237 written opinion total 6 pages, (Undated—this document is part of PCT/ISA/220 of Oct. 2009).*

(Continued)

*Primary Examiner* — Tony G Soohoo
(74) *Attorney, Agent, or Firm* — Brooks Kushman P.C.

(57) ABSTRACT

The invention relates to a mixing element for a flowable substance, comprising a body enclosing a cavity, wherein the cavity has at least one opening and the cavity and the opening are located relative to the body such that a fluid flow of the flowable substance out of the cavity through the opening transfers a torque to the mixing element. The invention further relates to the use of a tube or hose section as such a mixing element and a mixing device comprising such a mixing element, a container, and a sound source coupled thereto for generating an oscillating pressure.

25 Claims, 6 Drawing Sheets

(56) References Cited

U.S. PATENT DOCUMENTS

| | | | | |
|---|---|---|---|---|
| 6,811,822 | B2 | 11/2004 | Frese et al. | |
| D532,242 | S * | 11/2006 | Aikens | D7/300.2 |
| D567,004 | S * | 4/2008 | Bottega | D7/300.2 |
| 7,731,101 | B2 * | 6/2010 | Fabrizio et al. | 239/33 |
| D638,244 | S * | 5/2011 | Wallace | D7/300.2 |
| D655,121 | S * | 3/2012 | Wallace | D7/300.2 |
| 2002/0185547 | A1 * | 12/2002 | Kaplan | 239/33 |
| 2003/0133359 | A1 * | 7/2003 | Bittner | 366/343 |
| 2003/0175947 | A1 | 9/2003 | Liu et al. | |
| 2003/0230635 | A1 * | 12/2003 | Banach | 239/33 |
| 2004/0076074 | A1 * | 4/2004 | Shubeck | 366/129 |
| 2006/0027675 | A1 * | 2/2006 | Takeda | 239/33 |
| 2007/0211562 | A1 * | 9/2007 | Pitsis | 366/129 |

OTHER PUBLICATIONS

PCT/ISA/237 written opinion total 7 pages, English translation (Undated—this document part of PCT/ISA/220 of Oct. 2009).*

Robin H. Liu, et al., "Bubble-induced acoustic micromixing", Lab Chip, 2002, 2, pp. 151-157.

R.J. Dijkink et al., The 'acoustic scallop': a bubble-powered actuator, J. Micromech. Microeng. 16 (2006), pp. 1653-1659.

Piotr Garstecki et al., "Design for mixing using bubbles in branched microfluidic channels", Applied Physics Letters 86, 244108 (2005).

* cited by examiner

ACOUSTIC MIXING ELEMENT AND MIXING DEVICE HAVING SUCH AN ELEMENT

The invention relates to a stirring element and to a stirring device having such a stirring element, for stirring and mixing in particular microscopically small amounts of flowable substances.

In the field of the invention, magnetic stirrers are known, for example, with magnetic stirrer bars that are driven magnetically without contact and that typically have a diameter of at least a few millimeters and a length of several millimeters to centimeters. Because of their dimension, magnetic stirrers of this kind are unsuitable in particular for use in microfluidics and biological microfluidics. Their range of use is also limited wherever magnetic fields are undesired. This can be the case, for example, when using magnetic beads, which are added to the liquid for the specific extraction of cells, DNA, proteins and the like.

The vortex mixer uses another mixing method. Here, liquids of different density are mixed together in a container as a result of inertial forces by movement of the container. In this case too, there are natural limits to miniaturization. This mixer is suitable for liquid amounts of a few tenths of a milliliter but not for less than this.

Passive diffusion mixing methods and devices are also known. However, the mixing times in diffusion mixing are relatively long.

In the article "Bubble-induced acoustic micromixing" by Robin H. Liu et al., Lab Chip, 2002, 2, 151-157, a device for mixing very small amounts of liquid (22 μl) is also proposed which comprises a chamber, filled with the liquids that are to be mixed, and cavities that are arranged peripherally and are connected to the chamber. Air bubbles trapped in the area of the cavities undergo resonant oscillation by acoustic excitation and, in so doing, also set the surrounding liquid in motion, which leads to more rapid mixing of the latter.

By contrast, the object of the present invention is to make available a stirring element and a stirring device for a flowable substance or liquid, which element and device can be used universally, in particular for mixing very small amounts of liquid.

The object is achieved by a stirring element according to claim 1, a use according to claim 16, and a stirring device according to claim 18.

The stirring element comprises a body that encloses a cavity. The cavity is connected via an opening to the area surrounding the body. According to the invention, the cavity and the opening are arranged relative to the body such that a fluid stream of the flowable substance or liquid emerging from the cavity through the opening transfers a torque to the stirring element.

The stirring device comprises a container for the flowable substance, at least one of the aforementioned stirring elements, and a sound source coupled to the container in order to generate a pressure oscillation.

Unless otherwise specified, a cavity is understood here generally as a hollow space of any desired shape. In this context, the term opening describes the outlet cross section of the cavity in a projection onto the body surface at the outlet site. The end portion or outlet channel of the cavity near the opening is referred to hereinbelow as the mouth.

The invention exploits the principle, known in fluid dynamics, whereby a fluid emerging from a tube leaves the latter in the form of a directed jet, whereas a fluid sucked into the tube enters the tube as it were from the whole of the available solid-angle range. The principle, which applies only for sufficiently high Reynold numbers, Re≥about 50, is described in the article "The 'acoustic scallop': a bubble-powered actuator" by Dijkink et al., Journal of Micromechanics and Microengineering, 16, 2006, 1653-1659. The article proposes using the principle as a drive for an "acoustic windmill". A Teflon tube, closed at one end, is accordingly immersed in a container filled with water, after which an air bubble is enclosed in the capillary thereof. Sound is introduced through the water into the air bubble by means of a piezo actuator, and the air bubble is thus caused to oscillate. The alternating expansion and contraction of the volume alternately sucks liquid into the tube and ejects it again. The described asymmetry between the directed ejection and the undirected suctioning results, when seen across a complete oscillation, in a total impulse being transferred to the tube, which is used to drive the latter in the direction of its longitudinal axis.

By contrast, the use of such a tube as an independent stirring element is not known. The invention exploits this principle but, in contrast to the linearly driven Teflon tube, uses a body with a cavity, in which the cavity and the opening thereof are arranged relative to the body such that the total impulse resulting across a complete oscillation does not coincide with the direction of the longitudinal axis of the body, or to be more precise is not directed to the center of gravity, but instead generates a torque and thus causes an accelerated rotation of the body about its center of gravity.

The stirring element thus becomes an acoustic stirrer bar which, as is known from magnetic stirrer bars, is added to the liquid that is to be stirred, without a special container being needed for this. Moreover, its use is not limited by magnetic sensitivity and is therefore more universal.

Compared to the known stirring appliances and stirring elements, the acoustic stirrer bar according to the invention also has the advantage that the physical principle also functions at microscopic dimensions. With suitable miniaturization, the stirring element according to the invention can also be used in microfluidics, i.e. for stirring or mixing amounts of liquid that have a volume of a few microliters, which does not exclude the possibility of small stirring elements, suitable for this purpose, also being able to be used to effectively mix a larger amount of liquid, by addition of a suitably greater number of these small stirring elements.

The stirring elements can be used in closed sample preparation chips (known as "lab on a chip"), which are employed in particular in microfluidics, and also in open or closed "macroscopic" vessels.

According to one aspect of the invention, the preferred one-piece body has several openings, and the cavity and the openings are arranged relative to the body such that the sum of all the fluid streams emerging through the several openings transfer a torque to the stirring element.

In this case, the openings can each communicate with a separate cavity or with connected cavities or a single cavity.

Because easy to produce, the body is preferably tubular, and the interior of the tubular body forms the cavity.

This can be done, for example, by using a tube section or hose section as stirring element, in which the interior forms the cavity.

For the operating principle, it suffices that the cavity is designed, in the mouth area, in such a way that a directed jet emerges from it and ensures the aforementioned impulse transfer. The direction of flow of the emerging jet of fluid can be set, on the one hand, by the orientation of the cavity or the mouth thereof and, on the other hand, by the arrangement or shape of the opening, or by a combination of both features. In a simple configuration, the cavity, at least in the mouth area, has a tubular or channel-shaped portion (of constant cross section) and, in a complicated configuration, it has a special nozzle geometry, for example in order to increase the drive efficiency. If, for example, the opening lies in a plane oblique to the axis of a cavity that has the form of a simple bore, this will ensure a deflection of the flow away from the axis of the outlet channel or bore.

The latter principle is implemented in an advantageous development of the invention in which the tubular body is straight and, at the opening, has (at least) one end face that lies in a plane not arranged at right angles to the longitudinal axis of the body.

In a preferred embodiment of the invention, this can be done very simply, for example, by a hose section or tube section being cut with a bevel at one or both ends.

By cutting the end with a bevel, the fluid emerging from the cavity in the form of a jet is deflected away from the longitudinal axis of the body. The reason for this is that the flow along the edge of the mouth (edge of the opening) tears off at different times. In this way, the impulse transfer to the hose section or tube section will also be oblique to the longitudinal axis and therefore not in the direction of the center of gravity. A torque is exerted.

To ensure that the force components exerting the torque transverse to the longitudinal axis of the tubular body with openings at both ends do not cancel each other, the ends should not be beveled in mirror image to each other. The two end faces preferably lie in planes that are parallel to each other and not at right angles to the axis of the body. This configuration ensures a pure rotation movement of the stirring element about its center of gravity.

The stirring element according to the invention can also execute a more complex rotation about several axes (tumbling motion) by arranging the end faces preferably in planes whose normals through the respective centers of the openings are arranged askew to each other.

Of course, one of the end faces can also be arranged at right angles and the other obliquely with respect to the longitudinal axis of the hose section or tube section, or one of the two openings can be closed. In these cases, the stirring element in the form of the hose section or tube section will execute a rotation movement with a superposed linear movement.

In an alternative embodiment, the tubular body is bent and/or angled. In this way, end portions are obtained (at one end or at both ends) with a mouth that does not coincide with the longitudinal axis of he body. The emerging jet of fluid then emerges from the tubular body even with a right-angled end face to exert a torque.

The body of the tubular element is preferably provided with a cavity which is designed not to be wettable. This ensures that an air bubble enclosed in the cavity remains trapped there on account of the surface tension of the substance.

In the case of aqueous liquid, the entire body can be made, for example, of a hydrophobic material, such as polycarbonate or polytetrafluoroethylene.

The cavity is particularly preferably designed to be wettable in the area of the mouth. This ensures that some of the flowable substance flows at least into the mouth area as a result of the capillary effect and is available there as a liquid column to form the stream of fluid.

The stirring element is also preferably designed to be wettable in the area of the outer surface, such that it is ideally unwettable only in the inner area of the cavity, except for the mouth(s).

This measure also reduces the danger of the stirring element collecting on or adhering to a vessel wall.

A local wettability of the surface of the cavity in the area of the mouth and/or of the outer surface can be achieved by surface modification.

Accordingly, when used in an aqueous solution, the body is either made of a hydrophobic material and rendered hydrophilic in the area of the mouth and/or of the outer surface, or the body is made of a hydrophilic material and rendered hydrophobic in the area of the cavity (cavities), if appropriate except for the mouth (mouths).

It can ideally be rendered hydrophilic or hydrophobic in a known manner by an immersion method, as is described in DE 100133111C2, or by a coating. Polycarbonate, for example, as a weakly hydrophobic material can be rendered hydrophilic by $O_2$ plasma treatment on the surface.

In an alternative construction, the stirring element is composed of two tube sections or hose sections lying one inside the other, of which the inner one is non-wettable (hydrophobic) and the outer one is wettable (hydrophilic). The outer hose section can also be longer, in order to form wettable mouth areas. Such a construction can be obtained, for example, by simply pushing the tubes or hoses one over the other or by co-extrusion. Instead of the outer hose section or tube section, it is also possible to provide a kind of net or film covering.

When the stirring elements are used in apolar organic liquids, lipophilic surfaces can accordingly be used in the area of the outer surface and/or of the mouth, and lipophobic surfaces can be used in the area of the cavity (cavities), if appropriate except for the mouth (mouths).

Alternatively or in addition, it is possible to provide a pressure-increasing means which is connected to the container of the stirring device and by means of which the flowable substance is subjected to a pressure and therefore penetrates into the mouth area of the cavity upon compression of the gas bubble enclosed in the cavity. The flowable substance is then once again available as a liquid column for forming the stream of fluid.

In an advantageous development, the stirring element comprises a spacer, which is designed to prevent direct adherence of the body, in particular at one of the end faces, to a container wall.

In the stirring device according to the invention, the container can be formed by a chamber in a sample preparation chip.

To ensure that the stirring element or stirring elements remain in the container (or in the chamber of the sample preparation chip) and are not transported away with the liquid, the container is delimited by retainer elements or by narrowed areas with opening cross sections that are smaller than the smallest dimension of the stirring elements.

The sound source used is, for example, a loudspeaker or the like, preferably a piezo actuator coupled to a container wall.

The sound field is preferably introduced into the gas bubble via a container wall and the substance to be stirred, in order to minimize losses caused by any substantial impedance differences. The sound source is therefore preferably connected to the container wall in an area which is in contact with the flowable substance during operation of the stirring device.

In order to optimize the introduction of sound into the gas bubbles contained in the cavities of the stirring elements, gas cushions with a large surface area and large volume on a liquid surface should also be avoided. This can be done by providing the container with a cover or lid which is flexible or fits as tightly as possible and which can be adapted to the liquid level, or by ensuring the smallest possible interface between the liquid and the environment, for example by a constriction of the container in the filling area.

The stirring device preferably has a control system which is designed to set a frequency on the sound source that corresponds to the resonant frequency of a gas bubble enclosed in the cavity of the stirring element.

Further objects, features and advantages of the invention are explained in more detail below on the basis of illustrative embodiments and with reference to the drawings, in which.

Figure 1A:
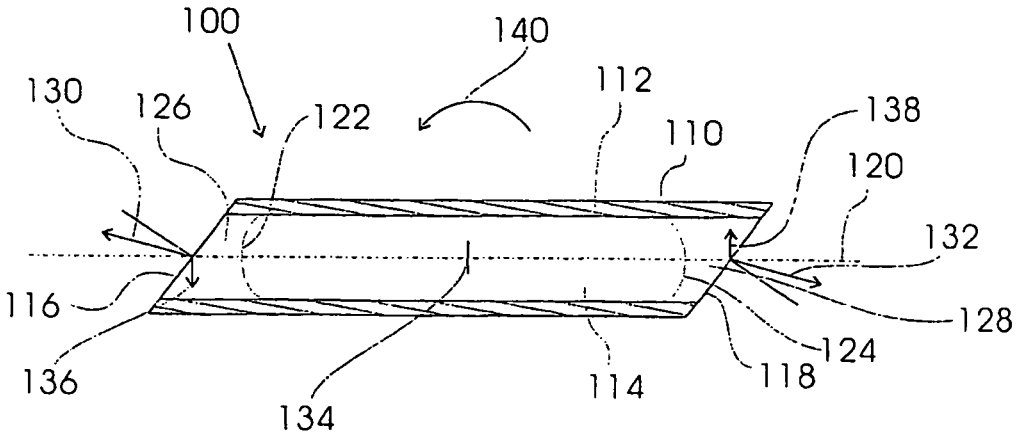
FIG. 1 shows the stirring element according to a first embodiment with a tubular body and two beveled end faces, at the moment when liquid is ejected (FIG. 1A) and at the moment when liquid is sucked in (FIG. 1B)

The stirring element 100 according to the illustrative embodiment shown in FIG. 1 is the simplest embodiment from the point of view of manufacture. It is composed of a tube section or hose section 110, which forms the body of the stirring element 100. The interior enclosed by the tube section or hose section 110 forms the cavity 112 of the stirring element 100 in which a gas volume or a gas bubble 114 is enclosed as elastic medium. The hose section or tube section 110 is cut with a bevel at both ends, such that beveled end faces 116, 118 are formed there. Beveled in this case means that the end faces 116, 118 do not form a right angle with the longitudinal axis 120 of the body. The end faces 116, 118 here lie in parallel planes. In this way, the cavity 112 forms an oval opening in the projection planes of the end faces.

If the stirring element 100 is immersed in a liquid or a flowable substance, interfaces 122, 124 form between the enclosed gas bubble 114 and the liquid passing through the end openings into the mouth areas of the cavity 112. In the illustrative embodiment shown, the cavity 112 is wettable in the mouth areas thereof, for which reason a liquid column 126, 128 forms in each case in the mouth area as a result of the capillary effect alone. To trap the gas bubble 114 safely in the cavity 112, the rest of the cavity is advantageously designed to be non-wettable by the liquid. When used in aqueous liquids, it is recommended that the body be made of a hydrophobic material, and that the hydrophobic property be cancelled out in the mouth areas of the cavity 112 by one of the surface modifications discussed above. Polycarbonate and polytetrafluoroethylene have proven to be suitable materials.

In addition to the embodiment shown, a dividing wall can be incorporated in the center of the stirring element. This would result in two cavities that were separated from each other and that were each closed at one end (also called blind bores), by means of which the position of the gas bubble would be stabilized.

When the gas bubble 114 is made to oscillate by application of sound, it will alternately contract and expand. The moment of expansion is indicated in FIG. 1A. By the expansion of the gas bubble, some of the liquid column 126, 128 is forced out from the cavity 112 as a fluid stream into the mouth areas at both ends. This fluid stream is directed. The resulting impulse of the fluid streams on both sides is indicated by the arrows 130, 132. As can be seen, the resulting impulse of the fluid stream is deflected away from the direction of the longitudinal axis 120 of the body, although the liquid column within the cavity 112 still flows in the axial direction. This can be explained by the fact that the fluid stream tears off at different times at the edge of the outlet opening because of the beveled end faces. In doing so, it is deflected in the direction of the edge area at which it first tears off.

The forces acting on the stirring element from the impulses of the fluid streams are preferably considered in the center of gravity system of the stirring element. The center of gravity is identified by 134. The force components acting from the centers of the openings in the direction of the center of gravity 134 cancel each other out. This results in a force couple composed of opposite and equal forces 136, 138, which act at the center points of the outlet openings. These cause a torque, identified by the arrow 140, which sets the stirring element 100 in a pure rotation movement.

Figure 1B:
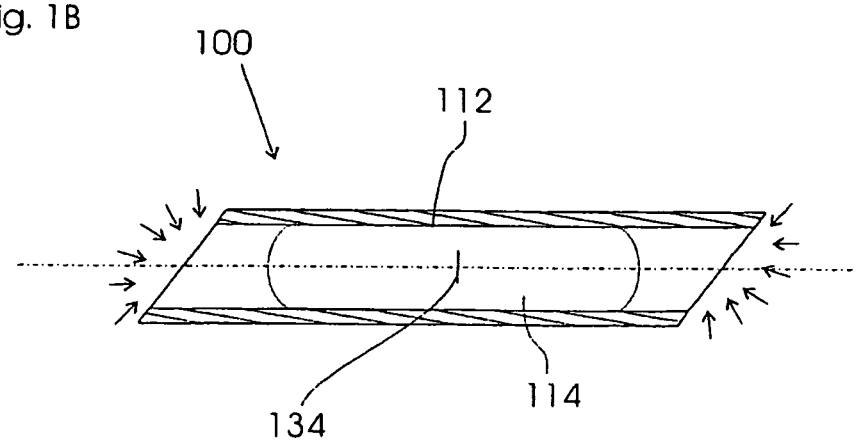

FIG. 1B illustrates the moment at which the gas bubble 114 is compressed as a result of an increase in pressure in the liquid. The liquid flowing into the mouth area of the cavity 112 has no preferential direction, unlike the liquid flowing out. Because of this, there is no appreciable impulse exchange between the liquid and the stirring element 100.

Overall, there is therefore an asymmetry between the suction movement and the ejection movement, which ensures that across a complete oscillation of the gas bubble (expansion and compression), a net overall impulse is transferred which sets the stirring element according to the invention in a rotation movement.

Figure 2:
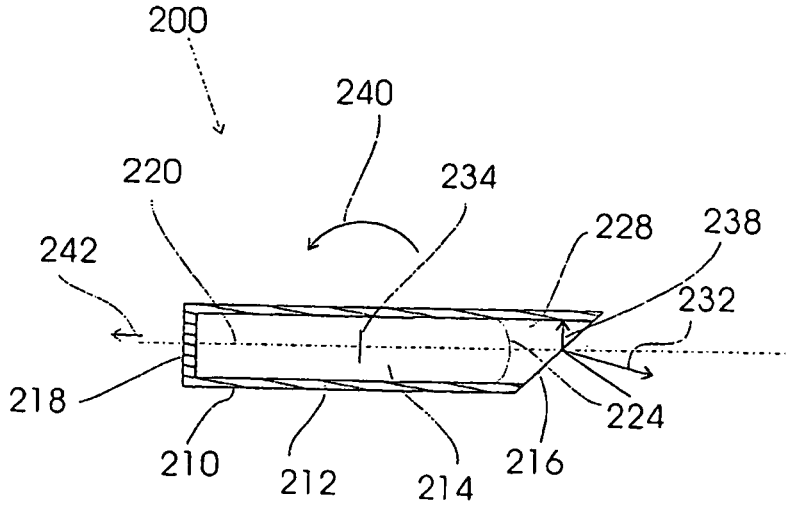
FIG. 2 shows another illustrative embodiment of the stirring element according to the invention, with a tubular body closed at one end.

FIG. 2 shows another illustrative embodiment of the stirring element 200 according to the invention with a tubular body 210. The enclosed space of the tubular body 210 again forms the cavity 212 in which, after the stirring element 200 is immersed in a liquid or flowable substance, a gas bubble 214 is enclosed. In contrast to the stirring element 100 shown in FIG. 1, the stirring element 200 has only one beveled end face 216, whereas it is closed at the opposite end face by an end wall 218. Consequently, when the stirring element is immersed in the liquid to be stirred, said liquid enters the cavity 212 only from the open mouth end and it forms a liquid column 228 there, as is indicated by the boundary surface 224.

When the gas bubble 214 is again caused to oscillate by application of an acoustic field, the liquid column 228 is forced out through the opening of the cavity, as has been described before, at an oblique angle to the longitudinal axis 220 of the body during expansion of the gas bubble 214. The resulting impulse of the fluid stream is identified by an arrow 232. The force acting on the stirring element 200 is divided in the center of gravity system (the center of gravity is at 234) into a component 238, which acts perpendicular to the longitudinal axis 220 of the body at the center of the opening, and a component 242, which extends parallel to the longitudinal axis. This results, on the one hand, in a torque 240 that acts on the stirring element, and, on the other hand, in an acceleration in the direction of the longitudinal axis 220 of the body. The stirring element 200 according to FIG. 2 will therefore execute a superposed rotary and linear movement.

Figure 3:
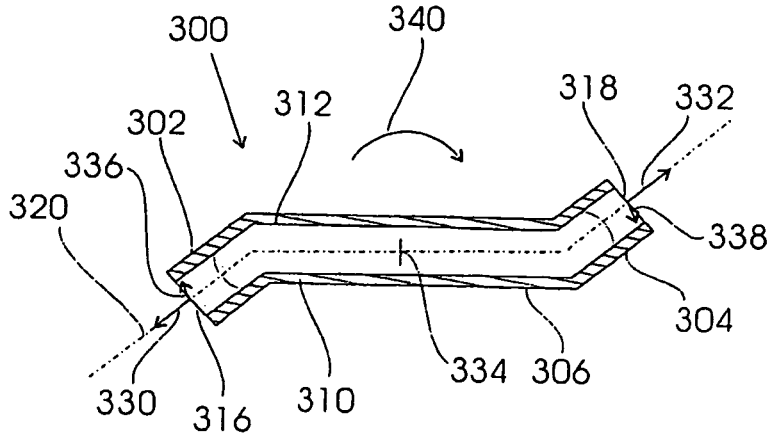
FIG. 3 shows a further illustrative embodiment of the stirring element according to the invention, with an angled tubular body.

FIG. 3 shows an embodiment of the stirring element 300 according to the invention, which has a tubular body 310 composed of end portions 302, 304 that are angled with respect to a middle portion 306. The body 310 has a cavity 312 open at both ends. The two end faces 316, 318 at the openings are at right angles to the center axis 320 in the area of the respective end portions 302 and 304 and therefore perpendicular to the mouth area of the cavity 312. The fluid stream generated upon ejection of the liquid from the cavity has, at both ends, the impulse indicated by the arrows 330 and 332. With respect to the center of gravity at 334, the reaction forces directed to the center of gravity add up to zero. There remains a force couple of identical forces 336, 338 acting at the opening center and directed counter to each other perpendicular to the connecting axis to the center of gravity, which applies a torque 340 and causes the stirring element 300 to move in a rotation movement about the center of gravity 334.

Figure 4:
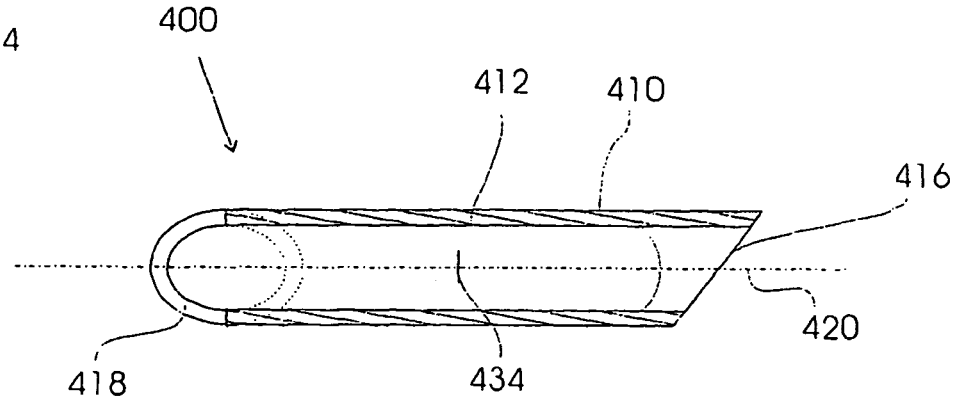
FIG. 4 shows a further illustrative embodiment of the stirring element according to the invention, with a tubular body whose two end faces lie in non-parallel planes extending obliquely with respect to the axis of the body.

FIG. 4 shows another variant of the stirring element according to the invention. As in FIG. 1, this has a tubular body 410 with an axial cavity 412 which, for example, is formed by a tube section or hose section. The cavity 412 forms openings at both ends of the body. The end faces 416, 418 at the openings are beveled with respect to the longitudinal axis 420 of the body. In contrast to the illustrative embodiment according to FIG. 1, the planes in which the end faces 416, 418 lie are not oriented parallel to each other, but in such a way that the normals to the planes (not shown) are askew at the midpoints of the openings. More precisely, in this embodiment, both the end faces 416, 418 are arranged at the same (polar) angle to the longitudinal axis 420 of the body. In this way, the force components acting on the stirring element during fluid ejection in the direction of the longitudinal axis of the body cancel each other out. The force components acting perpendicular to the longitudinal axis 420 of the body at both ends are rotated by the same (azimuth) angle relative to each other as the end faces 416 and 418. This results in two torques about different axes (not shown), which cause the stirring element to execute a complex tumbling motion about the center of gravity 434.

The illustrative embodiments according to FIGS. 1 to 4 show clearly that, in the stirring element according to the invention, a different arrangement of the end faces is all that is needed to generate different forms of movement from the superpositioning of linear and multiaxial rotation movements.

Figure 5B:
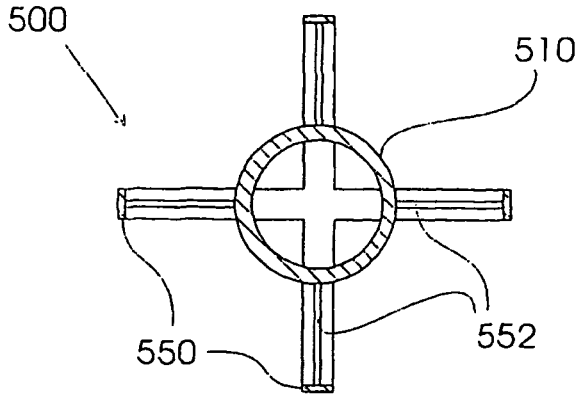
FIG. 5 shows an illustrative embodiment of the stirring element according to the invention, with a spacer structure in side view (FIG. 5A) and in front view (FIG. 5B)
Figure 5A:
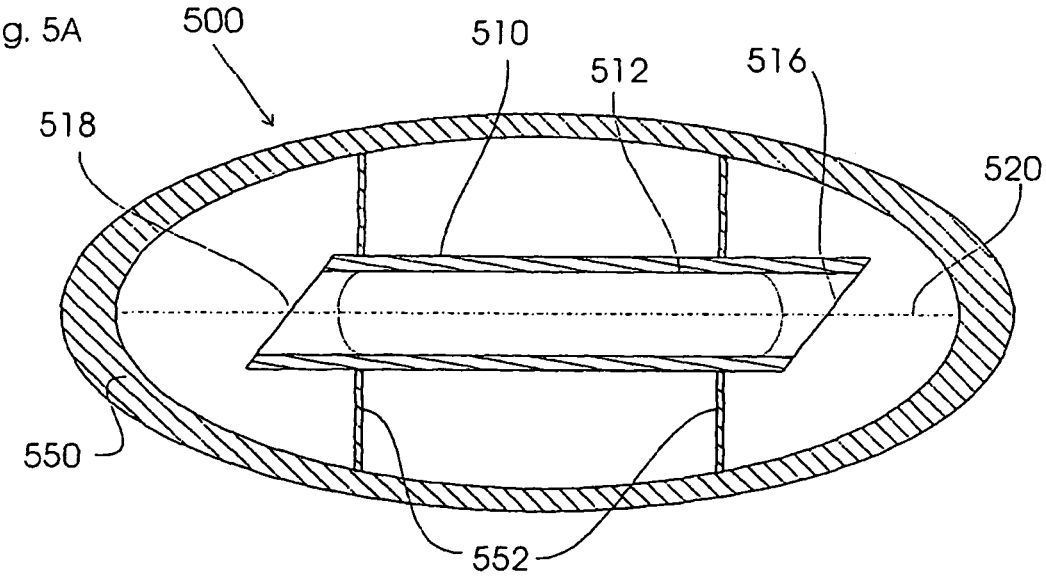

When the stirring element according to the invention is used in a vessel, the problem can arise that, if it makes contact with the wall, it is prevented from moving, in particular from rotating, or may even adhere to the wall as a result of adhesion forces. If a wettable outer surface of the stirring element does not adequately eliminate this problem, it is solved by a development according to FIG. 5. The stirring element 500 according to the invention again has a tubular body 510 with a continuous cavity 512 open at both ends. As in the illustrative embodiment according to FIG. 1, the end faces at the openings lie in parallel planes arranged obliquely with respect to the longitudinal axis 520 of the body. The stirring element 500 further comprises a spacer element 550 in the form of one, two or more oval rings surrounding the body 510. The rings lie in planes that enclose the longitudinal axis 520 of the body. They are held at a distance from the body 510 by support arms 552. Upon contact with a vessel wall, the end faces are kept at a distance and the openings remain free, such that the flow of fluid can take place unimpeded.

Figure 6A:
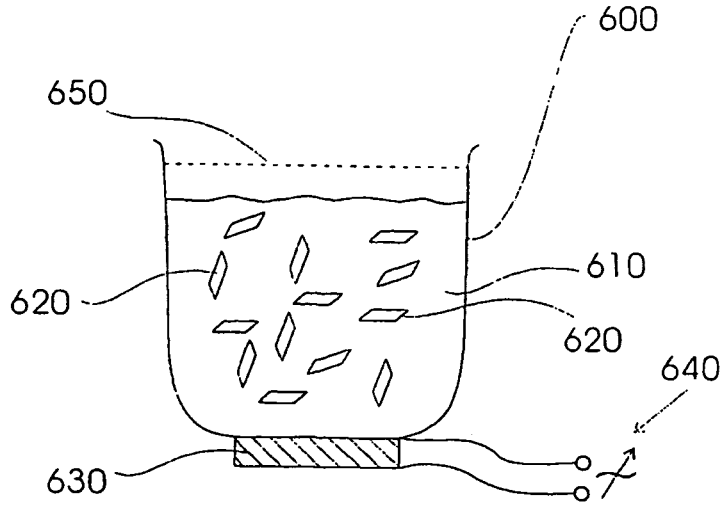
FIG. 6 shows an embodiment of the stirring device according to the invention.
Figure 6B:
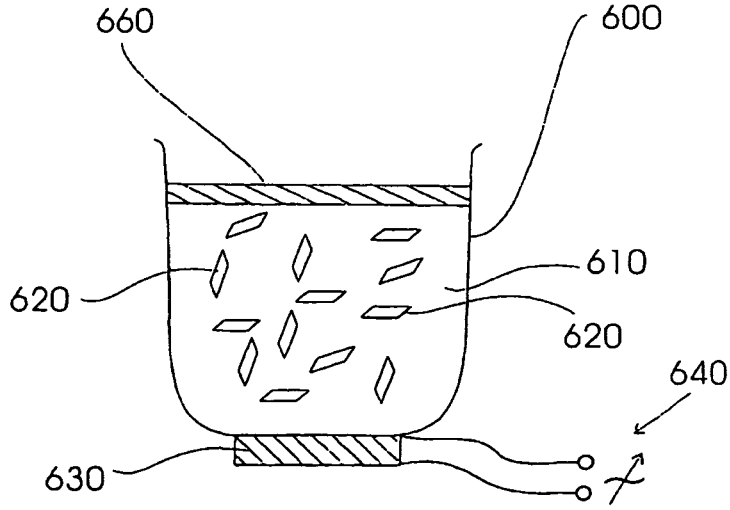

The stirring device according to the invention is shown schematically in FIG. 6. It comprises a container 600 which, for illustration purposes, has the form of a traditional beaker glass. The liquid or flowable substance 610 that is to be stirred or mixed is present in the container 600. A plurality of stirring elements 620 are introduced into the liquid 610. On the underside of the container 600, a sound source in the form of a piezo actuator 630 is coupled to the container wall, this area of the container 600 preferably being used for coupling since, on the opposite side of the container wall, liquid is available for decoupling and propagation of the sound. This reduces losses caused by substantial impedance differences during sound transmission, for example as a result of an air cushion adjoining the inner face of the container wall. In order to further increase the degree of efficiency, the large-volume gas cushion in the container 600 on the top face of the liquid 610 should be avoided. This can be done, for example, by adapting the volume of the container to the amount of liquid and closing it with a lid 660, as is shown in FIG. 6B. Alternatively, instead of the simple beaker glass shown here, it is possible to use a flask with a volume adapted to the amount of liquid and with a narrow opening, such that there is an extremely small interface between the liquid and the environment.

The piezo actuator 630 is connected to an alternating voltage source 640, which excites it to oscillation. By setting a suitable frequency, the coupled-in sound can be adapted to the resonant frequency of the gas bubbles enclosed in the cavities of the stirring elements. This ensures an increase in amplitude of the oscillation in the cavity and, therefore, an efficient utilization of the coupled-in sound.

After thorough mixing, the liquid or the flowable substance can be removed, for example by being poured out of the container 600, in which case the stirring elements 620 are held back in the container 600 with the aid of a suitable retainer element 650, for example in the form of a grid (illustrated only in FIG. 6A), and can optionally be discarded with the container. The retainer element 650, which is indicated schematically in FIG. 6A and extends across the entire opening of the container 600, can also be limited to the area of a pouring opening for example, in which case the rest of the container opening is closed by a lid, as in FIG. 6B. A condition according to the invention is that the retainer element 650 provides openings with cross sections that are smaller than the smallest dimension of the stirring elements 620, to ensure that the latter remain in the container 600 when the liquid is poured out.

Although the stirring elements according to the invention can also be used in such a container, a primary interest is to use them for stirring and mixing particularly small amounts of liquid. The operating principle is largely independent of the scale of the stirring elements, for which reason it is possible to use them in very much smaller vessels, for example in titer plates, Eppendorf capsules or in a chamber of a sample preparation chip. The latter use is illustrated in FIG. 7 and explained below.

Figure 7A:
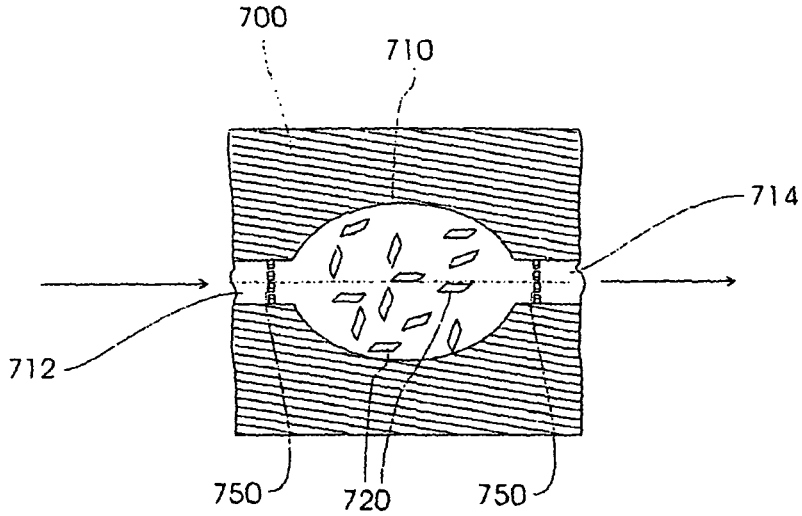
FIG. 7 shows a second embodiment of the stirring device according to the invention.

FIG. 7A shows a detail of a sample preparation chip 700 in which a chamber 710 is arranged for stirring or mixing one or more liquids. The chamber 710 is for this purpose connected to at least one admission line 712 and a discharge line 714. Several of the above-described stirring elements 720 are present in the chamber 710 and are able to move freely within the volume of the chamber 710. A sound source (not shown) is coupled, for example, to the top or bottom of the sample preparation chip. When the sound source used for the sample preparation chip is a piezo actuator, the latter can be pressed onto a cover film over the sample chamber. In this way, the piezo actuator is at the same time mechanically prestressed.

In the manner described above, the sound source causes an acoustic oscillation of the liquid in the chamber 710 and, therefore, of the air bubbles present inside the stirring elements 720. By means of the periodic movement of fluid that is generated in this way, the stirring elements are moved and the liquid is thoroughly mixed. Retainer elements 750 in the admission line 712 and also in the discharge line 714 ensure that the stirring elements 720 are held back in the chamber during delivery and discharge of the liquid.

Figure 7B:
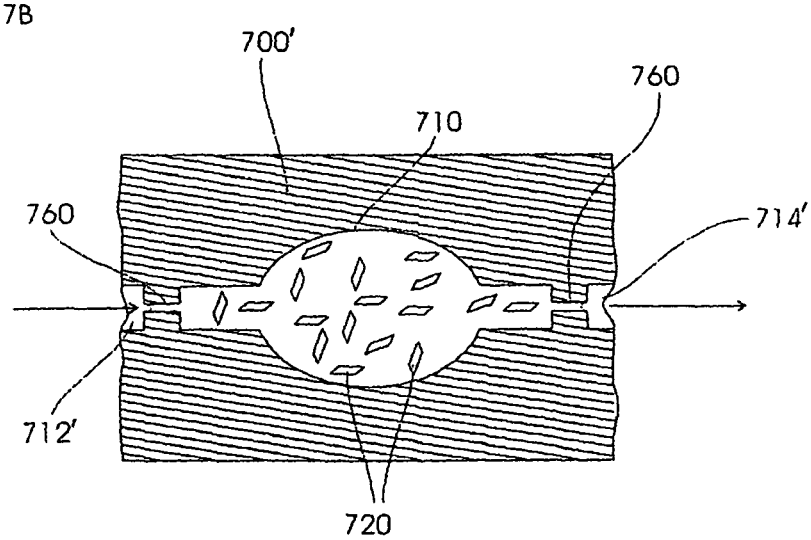

FIG. 7B shows a detail of a similar sample preparation chip 700', which differs from the one according to FIG. 7A only in terms of a differently shaped admission line 712' and a differently shaped discharge line 714'. The admission line and discharge line each have a narrowing 760 of their cross section. On the one hand, these narrowed areas form retainer elements 750 which prevent the stirring elements 720 from being transported away during delivery and discharge of the liquid in the chamber 710. On the other hand, the narrowed areas 760 serve to position and hold the liquid, or more exactly the liquid droplet or plug, in the chamber 710. For this purpose, the surface of the chamber 710 and of the admission line 712' and discharge line 714' is preferably wettable. The flowable substance thus penetrates into the narrowed areas and stops at the transition to the section of the discharge line 714' that follows in the direction of flow. In order to move the liquid onward and out of the chamber 710, energy has to be applied, since a surface increase takes place. The liquid is therefore kept safely in the chamber as long as there is no sufficient energy applied for onward transport.

In contrast to the illustrative embodiment according to FIG. 6, the illustrative embodiment according to FIG. 7 is suitable for continuous or quasi-continuous operation. In this context, quasi-continuous is to be understood as meaning a sequentially operating stirring device in which individual volumes of the liquid are guided one after another through the sample chamber and stirred or mixed.

As can be seen from the view in FIGS. 7A and 7B, the sample chamber is preferably designed without sharp corners or edges and has a shape that as far as possible promotes flow, so as to ensure that no residues of liquid are held back at places of low flow or at corners and edges, and that the chamber can be filled and emptied as completely as possible.

This preferably also applies to the cavity of the stirring element according to the invention, which cavity has a mouth in the form of a nozzle, with a mouth cross section that narrows in the direction of the opening to promote flow, and with a sharp tear-off edge in the plane of the opening.

As has been explained, the stirring elements can be used in a wide range of applications. In the configuration particularly suitable for mixing or stirring microscopic amounts of liquid, the stirring elements preferably have a length of 0.1 mm to 10 mm. The internal diameter of the cavity is preferably less than 1 mm and particularly preferably 0.1 mm to 1 mm. However, the principle of acoustic operation according to the invention also functions at the macroscopic level. Therefore, stirring elements in which the cavity has an internal diameter of up to about one centimeter and a length of up to several centimeters can also be used according to the invention.

Figure 8:
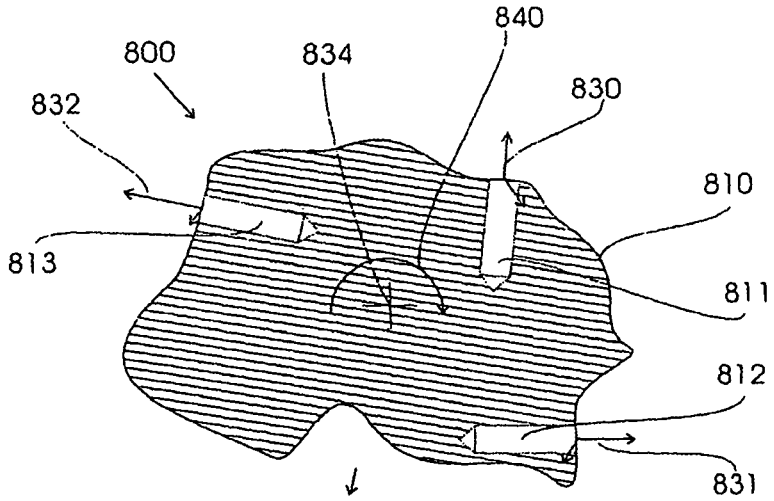
FIG. 8 shows the stirring element according to the invention in a more general form.

FIG. 8 is a schematic view of another form of the stirring element 800 according to the invention. In its most general form, it is composed of an asymmetric body 810 in which several cavities are formed, in this case three cavities 811, 812 and 813 in the form of blind holes. It is essential to the invention that the cavities 812, 813 and their openings are arranged relative to the body 810 such that the fluid stream emerging alternately from the cavities under the effect of sound has an overall impulse, here the sum of the individual impulses 830, 831 and 832, a torque being applied to the stirring element 800. In addition, the stirring element can experience a linear acceleration if the sum of the force components directed from the centers of the respective openings to the center of gravity do not add up to zero.

Reference is once again expressly made to the fact that the exact number and shape of the cavities is not important. One, two or more cavities can be provided. It is possible for two, more and/or all cavities to be separate from one another or connected to one another. In particular, the cavities can be connected to one another by a common hollow space in the body.

List of Reference Signs

100 stirring element
110 tube or hose sections/body
112 cavity
114 gas bubble
116 end face
118 end face
120 longitudinal axis of body
122 interface
124 interface
126 liquid column
128 liquid column
130 impulse of the fluid stream
132 impulse of the fluid stream
134 center of gravity
136 resultant force
138 resultant force
140 torque
200 stirring element
210 tubular body
212 cavity
214 gas bubble
216 end face
218 end face
220 longitudinal axis of body
224 interface
228 liquid column
232 impulse of the fluid stream
234 center of gravity
238 resultant force
240 torque
242 linear acceleration
300 stirring element
302 angled end portion
304 angled end portion
306 middle portion
310 tubular body
312 cavity
316 end face
318 end face
320 center axis
330 impulse of the fluid stream
332 impulse of the fluid stream
334 center of gravity
336 resultant force
338 resultant force
340 torque
400 stirring element
410 tubular body
412 cavity
416 end face
418 end face
420 center axis
434 center of gravity
500 stirring element
510 tubular body
512 cavity
516 end face

518 end face
520 longitudinal axis of body
550 spacer element
552 support arm
600 container
610 flowable substance/liquid
620 stirring elements
630 piezo actuator
640 voltage source
650 retainer element/grid
660 lid
700, 700' sample preparation chip
710 chamber
712, 712' admission line
714, 714' discharge line
720 stirring elements
750 retainer element
760 narrowing of cross section
800 stirring element
810 body
811 cavity
812 cavity
813 cavity
830 impulse of the fluid stream
831 impulse of the fluid stream
832 impulse of the fluid stream
834 center of gravity
840 torque

The invention claimed is:

1. A stirring element for a flowable substance comprising a body enclosing a cavity, the cavity having at least one opening and having a diameter and wettability to trap a gas bubble when immersed in the flowable substance, the cavity and the opening being arranged relative to a center of gravity of the body such that movement of the flowable substance through the opening caused by expansion and compression of the gas bubble transfers a torque to the stirring element.

2. The stirring element as claimed in claim 1, wherein the body has several openings, and the cavity and the openings are arranged relative to the center of gravity of the body such that movement of the flowable substance through the several openings, caused by expansion and compression of the gas bubble, transfers a torque to the stirring element.

3. The stirring element as claimed in claim 1, wherein the body is tubular, and an interior of the tubular body forms the cavity.

4. The stirring element as claimed in claim 3, wherein the tubular body is straight and, at the opening, has an end face that lies in a plane not arranged at right angles to a longitudinal axis of the body.

5. The stirring element as claimed in claim 4, wherein, at both ends, the tubular body has openings and end faces that each lie in a plane not arranged at right angles to an axis of the body.

6. The stirring element as claimed in claim 5, wherein the end faces lie in parallel planes.

7. The stirring element as claimed in claim 5, the end faces lie in planes, the planes each having a normal through a center of the openings such that the normals are arranged askew to each other.

8. The stirring element as claimed in claim 3, wherein the tubular body is angled with respect to a middle portion.

9. The stirring element as claimed in claim 3, wherein the tubular body is closed at one end.

10. The stirring element as claimed in claim 1, wherein the cavity, at least in part, is designed not to be wettable.

11. The stirring element as claimed in claim 10, wherein the body is made of a hydrophobic material.

12. The stirring element as claimed in claim 11, wherein the body is made of polycarbonate.

13. The stirring element as claimed in claim 11, wherein the body is made of polytetrafluoroethylene.

14. The stirring element as claimed in claim 1, wherein the cavity is designed to be wettable in an interior region of the cavity that is near the opening.

15. The stirring element as claimed in claim 14, wherein the body is made of a hydrophobic material and is rendered hydrophilic in at least one of an interior region of the cavity that is of the mouth near the opening and an outer surface.

16. The stirring element as claimed in claim 14, wherein the body is made of a hydrophilic material and is rendered hydrophobic in an inner region of the cavity that is inboard of the interior region of the cavity that is near the opening.

17. The stirring element as claimed in claim 14, wherein the body is made of a lipophobic material and is rendered lipophilic in at least one of an interior region of the cavity that is near the opening and an outer surface.

18. The stirring element as claimed in claim 14, wherein the body is made of a lipophilic material and is rendered lipophobic in an inner region of the cavity that is inboard of the interior region of the cavity that is, near the opening.

19. The stirring element as claimed in claim 1, wherein the body is designed to be wettable in an area of an outer surface.

20. The stirring element as claimed in claim 1, further comprising a spacer attached to the body to prevent adherence of the body to a container wall.

21. A stirring device comprising:
a container for a flowable substance;
a plurality of stirring elements as claimed in claim 1; and a sound source coupled to the container in order to generate a pressure oscillation in the flowable substance.

22. The stirring device as claimed in claim 21, wherein the container is formed by a chamber in a sample preparation chip.

23. The stirring device as claimed in claim 21, wherein the container is delimited by a retainer element with opening cross sections that are smaller than the smallest dimension of the stirring element.

24. The stirring device as claimed in claim 21, wherein the sound source has a piezo actuator and is coupled to the container wall.

25. The stirring device as claimed in claim 21, further comprising a control system, that is designed to set a frequency on the sound source that corresponds to the resonant frequency of a gas bubble enclosed in the cavity of the plurality of stirring elements.

* * * * *

UNITED STATES PATENT AND TRADEMARK OFFICE

CERTIFICATE OF CORRECTION

PATENT NO. : 8,591,093 B2
APPLICATION NO. : 12/597403
DATED : November 26, 2013
INVENTOR(S) : Friedhelm Schoenfeld It is certified that error appears in the above-identified patent and that said Letters Patent is hereby corrected as shown below:

In the Claims

Column 12, Line 2, Claim 7:

After "claim 5"
Insert -- wherein --.

Column 12, Line 23, Claim 15:

After "that is"
Delete "of the mouth".

Signed and Sealed this
Second Day of September, 2014

Michelle K. Lee

Michelle K. Lee
*Deputy Director of the United States Patent and Trademark Office*